United States Patent [19]

Taponier et al.

[11] 4,293,437

[45] Oct. 6, 1981

[54] PROCESS FOR THE TREATMENT AND PACKAGING OF LOW OR AVERAGE ACTIVITY RADIO-ACTIVE WASTE

[75] Inventors: Jean Taponier, Asnieres sur Seine; René Pierlas, Antony, both of France

[73] Assignee: Societe Generale pour les Techniques Nouvelles S.G.N., Montigny le Bretonneux, France

[21] Appl. No.: 28,453

[22] Filed: Apr. 9, 1979

[30] Foreign Application Priority Data

Apr. 13, 1978 [FR] France ..... 78 10963
Jul. 13, 1978 [FR] France ..... 78 20988

[51] Int. Cl.[3] ..... G21F 9/16

[52] U.S. Cl. ..... 252/301.1 W; 106/96; 106/99; 264/0.5

[58] Field of Search ..... 252/301.1 W; 106/99, 106/96; 264/0.5

[56] References Cited

U.S. PATENT DOCUMENTS 2,456,643 12/1948 Napier ..... 106/99
3,834,916 9/1974 Kesler ..... 106/99
3,988,258 10/1976 Curtiss et al. ..... 252/301.1 W
4,122,028 10/1978 Iffland et al. ..... 252/301.1 W

FOREIGN PATENT DOCUMENTS 2228938 1/1974 Fed. Rep. of Germany .
2356253 5/1975 Fed. Rep. of Germany ... 252/301.1 W
7222760 6/1972 Japan ..... 252/301.1 W

OTHER PUBLICATIONS

Napravnik, J. "Radioactive Wastes Incorporation into Bitumen and Cement", *Chem. Abs.,* vol. 80, (1974) #73977k.

*Primary Examiner*—Deborah L. Kyle
*Attorney, Agent, or Firm*—DeLio and Montgomery

[57] ABSTRACT

The present invention relates to a preferably continuous process for the treatment of low and average activity radio-active waste, comprising a pretreatment of said waste, a precipitation of radio-active compounds so as to form a stable suspension which may be superconcentrated, wherein from 0.6 to 2 parts by weight of cement for one part by weight of suspension, from 0.5 to 5% by weight, with respect to the cement, of asbestos fibres and possibly a complement of water necessary for ensuring setting of said cement are mixed, said suspension containing from 15 to 75% by weight of dry extract and a suspension agent, and the homogeneous mixture obtained is cast in a container.

7 Claims, No Drawings

PROCESS FOR THE TREATMENT AND PACKAGING OF LOW OR AVERAGE ACTIVITY RADIO-ACTIVE WASTE

The present invention relates to a preferably continuous process for the treatment of low and/or average activity radio-active waste, with a view to coating it in a solid form allowing storage thereof.

The problem of the treatment of low- and average activity radio-active waste has been studied for numerous years and has led to various solutions. This problem consists in suitably treating and packaging all the radio-active waste so as to allow storage thereof in suitable places and for periods of time corresponding to the life of the various radio-active constituents that it contains.

The general method used contains in enclosing the radio-active constituents in a solid, stable, inert material so that the whole has a suitable safety level for packaging this waste.

Among the recommended solutions, it is known to concentrate the various radio-active constituents of low and average activity contained in the waste, particularly in an evaporator, then to mix these constituents with a cement, sand and aggregates so as to constitute a concrete which will be cast in a metal container. However, this widely used technique presents particular technical disadvantages, mainly in that considerable volumes of concrete are employed.

Furthermore, the use of bitumen for coating liquid radio-active waste, with a view to solidification thereof, is a known process; but, in a process of this type, it is always recommended to evaporate the free water from the solutions and suspensions containing the radio-active products so as to have to cast in a container only a mixture of bitumen with salts and precipitates containing only a very small (generally less than 1%) quantity of water. Moreover, the fear associated with the risk of inflammability of the bitumen has, up to the present time, limited the development of this albeit promising process. Finally, it has already been recommended to use mixtures of bitumen with concretes (cement and sand) for coating solid radio-active waste.

The present invention enables these difficulties to be overcome, in particular by providing a series of technological operations by which the waste can be treated and packaged, preferably continuously, under the best conditions, producing solid coated products based on cement presenting good mechanical characteristics and a reduced volume.

The invention is based on a certain number of ideas which may be expressed as follows:

it has been found that the mixtures solidified from cement, water and waste had a sufficient mechanical strength and resistance to storage to be used without having to add sand and inert aggregates to said cement, on condition that these mixtures comprise, as reinforcing element, a certain quantity of fibres; these fibres will preferably be asbestos fibres. The mechanical strength of the solidified mixtures will depend, all else remaining equal, on the nature of the cement used; from this point of view, a Portland cement having high mechanical characteristics will, for example, be used;

it has further been found that, for making the above-described mixtures, it was neither necessary nor desirable that the radio-active substances be brought to the dry state; on the contrary, it was possible to make a solidifiable mixture, homogeneous in the whole of its volume, of cement, water and waste, using a concentrated suspension of this waste; this suspension must, itself, be homogeneous, must have a low sedimentation and a very high power of maintaining the solid particles in suspension and, to this end, it is desirable that said suspension contains at least one additive of the alkaline silicate type; moreover, said suspension may contain special additives such as fluidizing agents, anti-foam agents or agents promoting the operations which are carried out on said suspension;

it has been found that it was desirable to package the solidifiable (and solidified) mixtures of cement, water and waste as obtained, not in metal drums but in containers constituted essentially of asbestos-cement; asbestos cement pipes are known to technicians; they will form, after sectioning and obturation of one of their ends, the basic elements for packaging according to the invention; the containers based on asbestos cement, due in particular to the analogy of structure of the firm bond between their inner surface and the mixtures that will be packaged therein, appear as choice materials for making storable masses;

finally, it has been found that it was possible, whilst maintaining the essential advantages resulting from carrying out the above-described means, to add to the mixtures of cement and waste from 5 to 30% by weight, with respect to the cement, of bitumen.

Starting from these various technical elements, it has been possible to carry out a reliable process according to the invention for treatment and possibly packaging of the low and average activity radio-active waste.

The process according to the invention firstly comprises, in a preliminary stage, a pretreatment of the liquid waste consisting, after analysis, selection and prestorage of the liquid waste to be treated, in constituting solutions or mixtures, containing the radio-active substances, but from which the excess of liquid or sludge requiring specific treatment is removed, if necessary, in order thus to constitute relatively homogeneous batches vis-à-vis the subsequent treatments. These batches will be treated in one or more successive operations, after the possible introduction of sulphate or nitrate ions, by an alkalizing agent, preferably baryta, so as to bring their pH progressively to about 8.5 and to precipitate compounds, particularly heavy metals, of radio-active character.

The final purpose of this precipitation operation is the preparation of a stable suspension comprising about 40 to 400 g of solid matter precipitated per liter of suspension, and containing at least 90% of the radio-elements initially present in the solution.

To obtain such a stable suspension, it is necessary for said suspension to contain a suspension agent of the alkaline silicate type.

Either said suspension agent may therefore be added before effecting the precipitation operation so as to obtain a stable suspension of precipitated matter directly, part of the precipitation may be effected in the absence of suspension agent and the suspension agent may then be added, this resulting in the return of the precipitated matter to the state of stable suspension;

or the precipitation may be effected in the absence of suspension agent, a decantation of the precipitated matter may then be effected with extraction of the aqueous part, said latter possibly being able to be treated and partly recycled in the installation, then the precipitate may be returned into stable suspension by the addition of the suspension agent.

The stable suspension obtained preferably comprises at least one part of the asbestos fibres which will be necessary during the final mixture with the cement. This suspension may also comprise other additives such as a plasticizing agent and/or cement setting retarder of the calcium lignosulphonate type, an anti-foam agent; these additives may, according to the modus operandi chosen for obtaining the stable suspension, be added either before or after the precipitation operation.

The suspension as defined hereinabove will advantageously be subjected according to the invention to a superconcentration which will consist in evaporating a certain proportion of the water contained in the suspension; this evaporation will be effected by heating to a temperature of about 70°-130° C. until a thick but castable suspension is obtained which contains, in the dry extract state, from 30 to 75% by weight of solid, then the suspension obtained is cooled and mixed with the cement and possibly a complement of water, the relative quantities of cement and suspension being between 0.6 and 2 kg of cement per kg of suspension and the duration of mixing being between about 1 and 10 minutes, then the mixture obtained is cast in a container.

The essential purposes of the preliminary treatment effected within the scope of the invention are as follows:

to reject the largest possible volume of sufficiently decontaminated waste;

to concentrate the initial activity (by a factor 10 to 1000 according to the cases) to a minimum volume;

to use chemical reagents such, in nature and quantity, that the dry extract of the radio-active solutions obtained further to these treatments is minimum;

to obtain relatively homogeneous batches of well defined characteristics of the different types of waste thus treated and, in order to attain these goals, known processes will be used which will be adapted to the nature of the waste to be treated.

The specific precipitation stage of the radio-isotopes is carried out according to known techniques which may be a function of the nature of the waste treated. In particular, it is known that the precipitation of the radio-isotopes may be effected in several successive stages, for example at increasing pH values. The purpose of this precipitation is to bring at least 90% and preferably 95% of the radio-isotopes present in the treated waste to the state of solid, insoluble particles. In fact, this precipitation should be conducted so that the liquid part of the suspension obtained presents a radioactivity which may be considered as being very low, in view in particular of the possibility of redissolution of this liquid when it will have been introduced into the cement.

The preferred suspension agent is sodium silicate; this product may be added either before any precipitation, during precipitation or at the end of precipitation after a possible separation of part of the liquid. The quantity of sodium silicate used is generally of the order of 0.2 to 6 g per liter of suspension.

At this same stage of the invention (i.e. before, during or after precipitation), it is advantageous to add all or part of the additives which may be considered necessary for the final mixture. Mention may be made, among these additives, of:

the necessary asbestos fibre which will advantageously be added at this stage as it plays a role in the stability of the suspension;

an agent fluidizing the subsequent cement-suspension mixture and/or a cement setting retarder, and an anti-foam product.

As asbestos fibre which will act in particular as agent reinforcing the mechanical properties of the cement-waste mixtures, fibres will preferably be used whose average length is between 1 and 8 mm; the total quantity of the fibres will be of the order of 0.5 to 5% by weight with respect to the weight of the cement.

When the asbestos fibre is not added, or is added only partially during precipitation, it will be possible to add said fibre at any of the subsequent stages of the process according to the invention.

As cement setting retarder and fluidizing agent for the cement paste, calcium lignosulphate will preferably be used; this product, used at a rate of 0.3 to 1% by weight with respect to the weight of the cement, enables the period of time lapsing between the contacting of the cement with the water in the mixer and the moment when the homogeneous mass obtained begins to set, to be controlled.

By carrying out the technique of precipitation by neutralisation, possibly in the presence of a suspension agent and asbestos fibres, it is envisaged to obtain stable suspensions which will be sent to the superconcentration operation. "Stable suspensions" here designate suspension of solids in aqueous solutions which virtually do not decant during periods of time which correspond to the durations of the manipulations and treatments of these suspensions in the process according to the invention.

The suspension obtained is then sent into a stirred evaporator with a view to superconcentration thereof; this superconcentration is generally effected by evaporation of a part of the water of the suspension; at the end of the operation, a new suspension will be obtained, of pasty type, castable when hot, which contains in the state of dry extract (i.e. all the solid matter obtained by bringing said suspension to dryness) 30 to 75% by weight of solid. This solid content of the superconcentrated suspension may, moreover, depend both on the main constituent of the radio-active waste and on the content of asbestos fibres used. For example, for an asbestos fibre content of the order of 1%, it may be admitted that the dry extract of said super-concentrated suspension may advantageously be:

about 30 to 45% if the main constituent of the waste is a borate, about 45 to 60% if the main constituent of the waste is a sulphate, about 50 to 75% if the main constituent of the waste is a nitrate.

The mixture of the suspension coming from the superconcentration stage with the cement and, possibly, the complement of water, is advantageously effected at a temperature of between about 10° and about 40° C.; to this end, the suspension coming from the superconcentration may on the one hand be cooled and, on the other hand, the temperature of the water and cement may be controlled and, finally, the temperature of the mixture may be cooled whilst it is being made, This is why there is advantage in using a cement having a hydration heat which is not too high and fairly slow setting speeds. It may also be desirable that the mixer comprises a cooling device.

The operational safety of the mixer is ensured by controlling the inlets and outlets of the materials in the mixer and by continuously measuring the torque to be furnished to the stirrer present inside said mixer; a double jacket may also be provided around the mixer, which double jacket may be heated to about 300° C. so as to provide a means for disaggregating the cement which might have set unduly inside said mixer.

The waste-additive-cement mixture in the course of setting is cast into containers. These containers may, a priori, be of any type, but, according to one of the features of the invention, containers will preferably be used of which at least the side wall is made of asbestos-cement. If necessary, for example if a high pressure might occur in the container, the asbestos-cement may be lined by an inner or outer metal wall, which is more resistant. The dimensions of the containers are chosen taking into account the radio-active activity of the cast mixture, the energy of the radiations emitted and the protection offered by said container.

A technique of concentric cylindrical containers may also be used according to the invention, said containers being located inside one another, and in which the central container will contain the most radio-active product, said inner concentric containers being materialised by a jacket or being constituted by the cement-waste wall of a previously cast and solidified mixture.

As indicated hereinabove, it is possible to add to the mixtures of suspension, cement and asbestos fibres described hereinabove, from 5 to 30% by weight with respect to the cement, of bitumen.

This incorporation of bitumen will preferably be effected due to the use of an aqueous emulsion of bitumen, used at a temperature compatible with the stability of the suspension, if necessary.

Said bitumen emulsion will advantageously be constituted by a stable emulsion with alkaline pH and at temperatures as high as possible (of the order of at least 80° C.), comprising from 45 to 60% by weight of bitumen (generally 55%) which may therefore be mixed cold;

either with the suspension leaving the superconcentrator, with the aid of a positive displacement pump enabling the rate of flow thereof to be known, or with the suspension supplying the superconcentrator, on condition, however, that the operational conditions thereof (particularly temperature and pressure) avoid breaking the emulsion (it will be necessary in this case to work under a relative vacuum), or with the initial suspension decanted, after the major part of the clarified solution has been drawn off and the suspension agent has been added.

When the bitumen emulsion is added to the radio-active suspension to be concreted, the percentages of dry extract of the mixture entering the concrete mixer will be very substantially the same as those defined previously, with a slight increase in the percentage for the borates (previously from 30 to 45%) and a slight reduction for the nitrates (previously from 50 to 75%), due to the relatively constant content (close to 55%) of the bitumen emulsions used.

The mixer ensuring the preparation of the cement paste may receive, in addition to the suspension described previously and the cement, a complementary intake of water to which may be added a superfluidizing additive of the hydrocarboxylic acid or polymerised synthetic resin type adapted to ensure a better castability of the mixture when leaving the mixer and, consequently, the use of a minimum quantity of water.

It is possible to incorporate at various stages of the invention, in the suspensions or mixtures present, radio-active products which it is desired to package, but which do not come from the precipitation of the active products initially contained in the waste. Such active products are for example ion exchanger resins, diatomaceous earths, filtration adjuvants, ashes or particles of shells of fuel elements. Each of these radio-active products will have to be introduced at a stage of the process when it does not disturb said process; this stage of introduction will depend on the physical, mechanical, chemical characteristics and on the level of reactivity of the products which it is desired to incorporate. Thus, if these products are previously ground ion exchanger resins, they may be introduced, according to their chemical nature and resistance to temperature, either upstream of the superconcentrator (particularly if said latter operates in vacuo), or at the inlet of the concrete mixer, in the case of ion exchanger resins in grains, they are preferably introduced at the inlet of the mixer;

if small size metal waste is concerned (for example shells passing through a mesh of 15 or 20 mm diameter), they will either be introduced separately in the storage container (before or immediately after the cement is cast), or in a special box located at the end of the continuous mixer after action of the mixing screws, so as to ensure a mixture of the metal waste with the cement paste prior to their introduction into the container but without risking a return of the metal waste into the mixing zone of the cement;

if the waste is of large dimensions, it will be introduced into the storage container prior to any introduction of solidifiable mixtures.

The following non-limiting examples illustrate the invention.

EXAMPLE 1

Treatment of the solutions of radio-active waste based on boric acid coming from PWR power stations.

The example concerns the treatment of the diluted solutions of boric acid containing small quantities of lithium and traces of radio-isotopes (cobalt and caesium in particular), coming from the primary circuit. It may be adapted to the case of these solutions being mixed with other liquid waste coming from this type of PWR power stations.

In the course of the preliminary stage, the diluted solutions are neutralised and concentrated until solutions are obtained which are not crystallizable at the temperature of 20° C. and containing 200 g/liter of boric acid equivalent ($H_3BO_3$).

The pretreatment of the preceding solutions consists in effecting in particular the precipitation of insoluble compounds of caesium, for example with the aid of a mixture of potassium ferrocy anide and of nickel sulphate, and also the precipitation of insoluble borates, for example with the aid of lime or baryta. The precipitates thus obtained will be returned into suspension by adding alkaline metasilicate (for example at a rate of 150 g of $SiO_3Na_2$ per kilogram of initial boric acid).

Under these conditions, a suspension is obtained which virtually no longer decants, of which the pH at 20° C. is of the order of 9 to 10, with a density of 1.175, a concentration of 175 g/l in boric acid equivalent and a dry extract at 150° C. of the order of 250 g/l of suspension (21% of dry extract). In order to avoid the secondary formation of crystals by the slow formation of complex salts present in the mixture thus obtained, it is preferable to effect the solidification treatment in the 48 hours which follow the preparation of the suspension.

If it is not desired to store the minimum volume of solidified waste, but if it is envisaged to obtain as high a mechanical compressive strength as possible, it will not be necessary, in this case, to effect a superconcentration of the preceding mixture.

Asbestos fibres are then directly added to the preceding suspension at a rate of 48 g per liter of suspension (the quantity of asbestos may vary, depending on the cases and the particular characteristics of the fibres, between 10 and 100 g per liter of suspension). The mixture of the suspension containing the asbestos with the cement, the fluidizing agent and retarder (for example an adjuvant plasticizing the concrete such as a calcium lignosulphonate) at a rate of 1% by weight with respect to the cement used, as well as the complement of water enabling the viscosity of the cement paste obtained to be regulated, will be effected for example in a mixer with two horizontal screws of the type such as those manufactured by LIST under the name AP Conti, operating continuously, coolable or heatable as desired by double jacket and heat-conveying fluid, with introduction of the cement via a feed regulator extruding screw. The dwell time in the continuous mixer is of the order to 2 minutes.

In the example considered, the test was made by mixing:

1.25 liters of suspension, or 1470 g and 128 g of boric acid, 60 g of asbestos fibres of Italian origin (quality 5RS)

0.28 liter of water for regulating the fluidity, 20 g of Plastiment BV 40 by SIKA (lignosulphonate), 2000 g of artificial Portland cement CPA 400.

2.18 liters of solid product are thus obtained, with a density of 1.750, containing 100 g of boric acid equivalent per liter of cement paste.

The mechanical compressive strength of such a sample, measured after 28 days, is 154 kg/cm$^2$.

If a minimum storage volume is sought for the solidified waste and if a lower mechanical strength will suffice, a prior superconcentration will be effected, enabling the content of dry extract of the suspension to be substantially doubled.

This operation will be effected in a superconcentrator reactor provided with slow and permanent stirring means enabling the walls of the apparatus, which are heated by double jacket and heat-conveying fluid, to be scraped. (A continuously operating, single-screw apparatus of the Discotherm Conti type, manufactured by LIST, may be suitable for this operation). An anti-foam additive is incorporated in the supply of the superconcentrator.

The steam escapes through the domes located in the top part of the horizontal axis mixer, then it is condensed and cooled before being rejected or recycled with the low activity waste according to its level of activity.

The concentrated pulp leaves at a temperature of the order of 80° to 90° C. It is directly introduced into a horizontal two-screw mixer where the mixing with the cement will be carried out, after a stage of prior cooling of the pulp in the first part of the continuous mixer.

The superconcentrator DT"B" Conti, with a capacity of 40 liters, heated with thermofluid to an average temperature of 190° C., is continuously supplied with the borated suspension with 21% of dry extract, at a rate of 72 liters/hour. About 32 liters per hour of distillate leaves therefrom, as well as 40 liters/hour of a very thick pulp containing 520 g/l of dry extract (density 1.36) of which 350 g/l are boric acid equivalent.

The cement paste is prepared in a two-screw mixer AP 12 Conti with a total volume of 12 liters.

The pulp leaving the superconcentrator (flow of 40 l/hr) and a mixture of water and calcium lignosulphonate are introduced simultaneously in the first part of this mixer, which is cooled with water. This mixture is introduced in a variable quantity in order to regulate the fluidity of the paste to be solidified. If the consistency of the pulp leaving the superconcentrator does not allow the introduction of the asbestos fibres in the supply pulp, the fibres will be introduced either in a predosed mixture with the cement, or in suspension in the mixture of water and fluidizing additive.

By way of example, operation was carried out with the following rates of flow:

Pulp: 40 l/hour, or 54 kg/hour
Cement: 50 kg/hour
Asbestos fibre: 0.5 kg/hour
Water: 2 l/hour
Plastiment BV 40: 0.5 kg/hour (lignosulphonate).

The product leaving the mixer is a cement paste of density 1.78 g/cm$^3$ which flows at a rate of flow of 60 l/hour in the asbestos-cement container.

The mixing time of the cement paste in the second part of the mixer is of the order of 6 minutes.

The final solid product comprises 233 g/liter of boric acid equivalent, or more than double the solid obtained in the absence of superconcentration.

The mechanical compressive strength of the samples thus obtained is 50 kg/cm$^2$ after 7 days and slightly exceeds 100 kg/cm$^2$ after 28 days.

EXAMPLE 2

Treatment of the average-activity waste coming from factories for the retreatment of nuclear fuels and annexed installations.

They represent about 30 m$^3$ per ton of fuel treated. The quantities of salts and precipitates which will have to be concreted should be limited to a minimum. To this end, the following arrangements will be made, whenever necessary:

elimination of the free nitric acid either by direct distillation or by destruction with the aid of formaldehyde or formic acid, neutralisation of the residual acidity by baryta instead of sodium hydroxide when the medium is nitric and in the absence of sulphuric acid;

use, if necessary, of solutions of waste containing sulphate ions (elution of exchanger resins for example) to precipitate the strontium and barium sulphates during the pretreatments, prior concentration of the waste solutions in order to limit the quantities of reagents necessary for the operations for the precipitation of the radio-isotopes.

Following the precipitation treatments which enable the major part of the activity to be brought together in a minimum volume, a separation of the clear liquid will be effected which will then be sent to be treated with the low activity waste.

With this process, the 30 m$^3$ of waste are firstly reduced to 20 m$^3$ before undergoing the different neutralisation and precipitation operations.

25 $m^3$ of solution are then obtained containing about 4% by volume of precipitate, or 1 $m^3$, which will be separated from the 24 $m^3$ of clear solution sent to the low activity waste.

The precipitate thus separated by static decantation will contain between 100 and 150 g of dry extract per liter, 80% being in the form of precipitate and 20% in the form of soluble salts.

About 20 kg of sodium metasilicate in powder form are added to this precipitate and 10 kg of treated asbestos fibres which will be placed in suspension. The pulp thus obtained will remain perfectly in suspension and may then undergo the operation of superconcentration in a suitable reactor for example of the Discotherm Batch or Conti type.

Following the superconcentration operation, the volume will be reduced from 1000 liters to about 400 liters, the dry extract then being of the order of 30 to 40%.

The superconcentrated hot pulp is then introduced into a stirred reactor of the AP Conti type to be cooled before being intimately mixed with cement in suitable proportions. An addition of water and plasticizer enables the consistency of the cement paste which will be cast into an asbestos-cement container, to be controlled and regulated.

The 400 liters, of density 1.25, will be mixed with 800 kg of cement and 8 kg of plasticizer diluted in 50 liters of water to give about 700 liters of solid of density 1.90.

Thus, the 30 $m^3$ of average activity waste are brought to a solid volume of 700 liters of cement paste, to 24 $m^3$ of low-activity waste and to 10 $m^3$ of distillate which may be rejected into the environment.

The mechanical characteristics of the concrete thus produced are relatively good, since it presents a compressive strength of the order of 100 kg/$cm^2$ after one week and 200 kg/$cm^2$ after 28 days.

The cement paste may be cast into asbestos-cement containers constituted from pipe elements which have been internally closed at one end by a flat asbestos-cement washer glued with the aid of a high resistance epoxy resin.

By way of example, an asbestos-cement container of 256 mm inner diameter and 500 mm high (useful volume of the order of 25 liters) is filled from the mixer AP 12 Conti during a period of time which may vary from 10 to 40 minutes according to the rates of supply of the mixer.

The upper cover, pre-coated with glue, will be applied on the upper pre-glued bevelled edge after the asbestos-cement container has been filled.

The assembly subjected to a test of mechanical axial compressive strength 6 weeks after casting, withstands, without breaking nor cracking, a pressure of 160 tons, corresponding to an average pressure of 215 kg/$cm^2$.

Placed on a horizontal genetratice, the breakage will take place on this same sample under a load of 71.7 t against 8 t only for the same empty pipe.

Due to the asbestos-cement jacket, the specific compressive strength is therefore very considerably reinforced.

EXAMPLE 3

In Example 2 hereinabove, it is possible that, during the separation, after precipitation, of a suspension containing the precipitate from a clear solution, this latter still presents too much radio-activity; it would be possible to treat said clear solution in the following manner:

The 24 $m^3$ of clear solution are concentrated to one tenth in order to obtain 2.4 $m^3$ of concentrates which will be mixed with 1 $m^3$ of precipitate; the mixture obtained undergoes the operation of superconcentration, addition of alkaline silicate, asbestos and anti-foam. The whole is then brought back to a volume of 1 $m^3$ containing 680 g/liter of dry matter (density 1.50). After concreting, 1.6 $m^3$ of concrete is obtained of density 2 after addition of 1.5 t of cement and 200 liters of water with 15 kg of plasticizer. The compressive strength of this concrete is not as good as in the preceding case, since its strength at 7 days is only 60 kg/$cm^2$, but it reaches 80 kg/$cm^2$ after 28 days. A homogeneous block without shell of asbestos-cement, with a diameter of 300 min, has undergone a clear break under a load of 60 t, applied 6 weeks after the casting of the concrete (compressive strength of 86 kg/$cm^2$). In this case, only the distillate of the superconcentration (2.4 $m^3$) is recycled to the low activity waste.

EXAMPLE 4

Treatment of the low activity waste coming from the factories for the retreatment of fuels and the annexed installations.

The volume of this waste is of the order of 70 $m^3$ per ton of fuel; its chemical nature is essentially composed of nitrates in a small concentration, mainly sodium nitrate, as well as of a small quantity of sulphate and oxalate ions.

It will be assumed, and this is generally the case, that the activity of these solutions is sufficiently low for the decanted solutions obtained after precipitation of the various radio-isotopes present to be able to be rejected into the environment after filtration and dilution.

After neutralisation up to pH 8.5 and precipitation of the various radio-elements, the volume of the solution is taken to about 90 $m^3$. The volume of the decanted precipitate is about 2 $m^3$, with a total dry extract of the order of 15% (precipitate and soluble salts).

This mixture may be cemented directly, with about 5 t of cement after addition of asbestos fibres and sodium silicate, this leading to a volume of concrete of the order of 4 $m^3$ (density of the mortar: 1.8 to 1.9). It may also undergo an operation of superconcentration, this enabling the volume of concrete to be reduced by half (2 $m^3$). In one or the other case, the slightly active concrete may serve as coating and primary biological protection for the more active, but less voluminous concrete blocks, made from the average activity waste.

In all cases, a larger volume of slightly active concrete will be available which will be cast in annular form in cylindrical containers in which the more active cylindrical containers will have previously been disposed.

EXAMPLE 5

Example 1 is repeated, but by adding to the pulp leaving the superconcentrator about 30% by volume, with respect to the final solidified product, of previously ground ion exchanger resins. In fact, it is known that the nuclear power station waste comprises a certain quantity of ion exchanger resins which present a radioactive character and which must consequently be suitably packaged.

The mixture is introduced into the mixer; a solid is obtained, with a density of about 1.55 which contains 30% by volume of resins, 1.35 g/l of boric acid equivalent and of which the mechanical strength is 38 kg/cm$^2$ after 7 days and 75 kg/cm$^2$ after 28 days.

EXAMPLE 6

Treatment of the low and average activity waste based on alkaline and alkaline-earth nitrates (sodium nitrate in the example in question).

After concentration of this liquid waste, neutralisation of the residual acidity and various treatments allowing in particular the coprecipitation of the strontium and barium sulphates, that of the mixed feroocyanides of nickel and caesium or potassium, a mixture of precipitates is obtained which are firstly concentrated by drawing off the clarified supernatant liquid then replaced in suspension by adding alkaline metasilicate and asbestos fibres.

The final pulp obtained without superconcentration has a pH of the order of 8.5 to 9, a density of 1.32 and an overall dry extract of 37% (of which 15% in the form of precipitates and the rest, viz. 22%, in the form of soluble salts).

The precipitated part essentially contains barium sulphate (about 75%), but also silica, asbestos as well as the salts of caesium and other precipitated radio-isotopes.

The soluble salts are essentially constituted by sodium nitrate and sulphate (about 90% in the form of nitrate).

This pulp is mixed cold with an emulsion of bitumen with 55% of bitumen before undergoing the concreting operation by simple addition of Portland cement, for example in a mixer with bowl used for experiments.

The following Table summarises the results obtained with different percentages of bitumen (these percentages are expressed by weight of pure bitumen with respect to the weight of the final solid obtained).

| | A | B | C | D |
|---|---|---|---|---|
| (a) Percentage of pure bitumen (%) | 0 | 3.8 | 10 | 14.5 |
| (b) Volume of pulp (cm$^3$) | 400 | 400 | 300 | 300 |
| (c) Weight of pulp (g) | 530 | 530 | 400 | 400 |
| (d) Weight of bitumen emulsion (g) | 0 | 85 | 200 | 360 |
| (e) Weight of cement (g) | 620 | 650 | 535 | 550 |
| (f) Total weight (g) | 1150 | 1265 | 1135 | 1310 |
| (g) Solid volume (cm$^3$) (g) | 645 | 745 | 710 | 880 |
| (h) Ratio of volume (b) | 1.61 | 1.87 | 2.37 | 2.94 |
| (i) Density of the solid | 1.79 | 1.71 | 1.60 | 1.49 |
| (j) Mechanical compressive strength (kg/cm$^2$) after 7 days | 84 | 65 | 50 | 32 |

This Table therefore shows that a high percentage of bitumen leads on the other hand to qualities of the bitumen which ensure an improvement of the resistance to lixiviation, a degradation of the mechanical properties and an appreciable increase in the volume of solids to be stored. This is why the contents of bitumen currently used will most often be included between 2 and 10%, and preferably equal to 8%.

The use of a cement of which the setting releases a minimum of alkali will be sought in order to improve the resistance to lixiviation.

EXAMPLE 7

Coating of metal shells, with or without prior rolling, in a cement paste made from pulp coming from the treatment of radio-active waste in which is incorporated a certain proportion of bitumen emulsion before effecting mixing with cement.

The waste solution which essentially contains sodium nitrate corresponds to the starting solution of Example 6. Further to the various treatments of precipitation, the sodium metasilicate is added which allows the return of the precipitate into suspension and the obtaining of a transferable pulp of density 1.24 and with an overall dry extract of 31%. This pulp then undergoes a stage of superconcentration by evaporation which takes its density to 1.59 and the dry extract content to 60%. A mixture of 5 parts by weight of superconcentrated pulp and one part of bitumen emulsion containing 55% of bitumen and 5% asbestos are continuously introduced at the inlet of the mixer.

The mixing operation with the cement is effected in a continuous LIST mixer of the AP 12 Conti type. This double screw apparatus receives, by the upper supply located near the drive motor, 150 kg/hour of a mixture of 5 parts by weight of the superconcentrated pulp and one part of bitumen emulsion containing 55% of bitumen and 5% asbestos. This mixture being at the temperature of 25° C. will cool in the first part of the mixer which precedes the introduction of the cement. A supply of cement at a rate of 130 kg/hour is also continuously effected midway along the apparatus. The cement paste, of density 1.90, flows continuously through an outlet box, located at the end of the apparatus opposite the motor, in an asbestos-cement container of 250 mm inner diameter and 500 mm high.

The waste solution which essentially contains sodium nitrate corresponds to the starting solution of Example 6. Further to the various treatments of precipitations, the sodium metasilicate and the asbestos fibres are directly added, this leading to a pulp of density 1.24 with an overall dry extract of 31%.

This pulp then undergoes a stage of superconcentration by evaporation which takes its density to 1.59 and the dry extract content to 60%.

The mixing operation with the cement is effected in a continuous LIST mixer of the type AP 12 Conti which continuously receives the superconcentrated pulp at a rate of 150 kg/hour of supply and cement at a rate of 130 kg/hour. A cement paste of final density 1.90 continuously leaves and is cast in an asbestos-cement container with an inner diameter of 250 mm and 500 mm high, which is filled with the cement paste leaving the LIST mixer. The neat cement paste thus obtained contains 390 g of sodium nitrate per liter and presents, after 28 days a mechanical compressive strength of 80 kg/cm$^2$.

The metal shells which will be incorporated in the cement paste thus prepared are constituted by pieces of stainless steel tube with an outer diameter of 12 mm and 1 mm thick, cut into sections of 3 and 5 cm length, in substantially equal proportions. After rolling in a crusher, the initial volume of the shells is brought to about 60% of their initial volume. The apparent density of the rolled shells, which is 2.1 kg/dm$^3$, may be taken to 2.5 kg/dm$^3$ after vibration. Thus, after rolling and vibration, the initial apparent volume of the shells thus treated is reduced by a factor 2.

During the first test A, a weight of 38.9 kg of rolled shells is poured progressively on the surface above the container freshly filled to two thirds (16.5 liters), whilst vibrating the asbestos-cement container disposed on a vibrating table. All the shells disappear beneath the cement and the final volume of the solid block thus obtained is 22.5 liters. The quantity of occluded air may be estimated at 4% of the total volume, by difference between the increase in volume observed and the actual volume of the rolled shells. The average density of the concrete with the shells thus coated is 3.14 kg/dm$^3$.

During a second test B, a second asbestos-cement container is filled with 20.4 liters of cement paste, then, as in the preceding test, shells of 3 and 5 cm length, but not having been previously rolled, are progressively poured. 22.3 kg of shells are thus incorporated and the final volume of the solid block is 23.5 liters. The quantity of occluded air, calculated in the same manner as before, may be estimated at only 1% of the total volume. The mean density of the concrete with the shells thus coated is of the order of 2.5 kg/dm$^3$ (the density of the neat cement paste being, this time, 1.8 kg/dm$^3$ against 1.9 in test A).

During the third test C, 38 kg of previously rolled shells of the same origin and composition as those having served in Example A, are introduced into a third asbestos-cement container, which shells then occupy a volume of 17 liters (apparent density 2.2). The liquid cement paste is then continuously cast whilst vibrating the container, until the container is filled up to 2 cm from its upper edge.

The mean density of the cast cement paste (1.84) and the measurement of the final volume enable it to be considered that practically no occluded air remains in the solidified mass (at the end of filling, numerous air bubbles could be observed which burst on the top surface of the cement paste).

This latter modus operandi therefore enables a maximum quantity of shells per unit of volume to be incorporated and a coated product to be obtained of which the final density may attain 3.6 kg/dm$^3$, or substantially double that of the neat cement paste. A last modus operandi D may also be effected by direct introduction into the container of the metal shells previously mixed with the cement paste leaving the mixer, this pasting being effected in a mixing box provided with a stirring device and disposed at the outlet of the mixer.

EXAMPLE 8

The starting radio-active waste solution is constituted by a mixture of magnesium and sodium nitrate. After neutralization and after having undergone the various precipitation treatments described previously, the return to suspension is effected with the aid of sodium silicate. The necessary quantity of asbestos is then added to this pulp, then the desired quantity of bitumen in the form of 55% emulsion (about 15% with respect to the initial pulp weight). After mixing, a transferable product is obtained, containing 34% dry extract which will undergo the superconcentration operation in a stirred evaporator operating in vacuo (Discotherm Conti type), at a temperature of 80° C., so as to preserve the stability of the bitumen emulsion. At the outlet of this evaporator, a black pulp is collected with a dry extract of 51% which is then introduced into the continuous mixer AP 12 Conti where it is cooled before mixing with the cement, also continuously introduced.

The composition of the product which flows in the asbestos-cement container is as follows:

cement: 49%
bitumen: 5.4%
asbestos: 0.6%
salts and precipitate: 20%
water: 25%

In certain cases, particularly when the level of radioactivity is high, it appears desirable not to close the container soon after filling thereof, but only after having attained thermal equilibrium and a sufficient level of hardness.

In these cases, a layer of inactive cement paste will advantageously be cast in the top part of the container in order to avoid a possible propagation of the contamination and to ensure a better confinement of the whole.

We claim:

1. A process for the treatment of low- and average-activity radioactive waste comprising:

(a) obtaining a homogeneous mixture of effluents containing said waste, (b) forming from said mixture a stable suspension of precipitated solid matter by precipitation of radioactive compounds, (c) adjusting the quantity of said solid matter to between about 40 to 400 grams per liter of precipitated suspension and adding from about 0.2 to 6 grams per liter of alkaline silicate, and a quantity of asbestos fibers such that the final mixture obtained in step (d) below comprises from about 0.5 to 5% by weight of asbestos fibers with respect to cement, (d) adding to said suspension from about 0.6 to 2 parts by weight of cement for each part by weight of said suspension, so as to obtain a homogeneous mixture, and (e) casting said homogeneous mixture into a container.

2. The process of claim 1, wherein only a portion of said quantity of said asbestos fibers is added in step (c) and the remainder is further added in step (d).

3. The process of claim 1, wherein, the alkaline silicate is sodium silicate and the level of solids in the suspension obtained in step (c) is adjusted to range between 30 and 75% of dry extract.

4. The process of claim 3, wherein the adjustment of said level of solids is effected by evaporation at a temperature of between 70° and 130° C.

5. The process of claim 3, wherein said stable suspension is made by precipitation in the presence of sodium silicate and at least a part of said asbestos fibres.

6. The process of claim 1, wherein said stable suspension also contains from 5 to 30% by weight, with respect to the cement, of bitumen.

7. The process of claim 6, wherein the bitumen is added in the form of a stable aqueous emulsion of bitumen containing 45 to 60% by weight of bitumen.

* * * * *

UNITED STATES PATENT AND TRADEMARK OFFICE

CERTIFICATE OF CORRECTION

PATENT NO. : 4,293,437

DATED : October 6, 1981

INVENTOR(S) : Jean Taponier, et al.

It is certified that error appears in the above—identified patent and that said Letters Patent is hereby corrected as shown below:

Column 1, line 17, "contains" should read -- consists --.

Column 12, line 50, "days" should read -- days, --.

Column 12, line 58, "60%"should read -- 61% --.

Signed and Sealed this

*Fifth* Day of *January 1982*

[SEAL]

*Attest:*

GERALD J. MOSSINGHOFF

*Attesting Officer*

*Commissioner of Patents and Trademarks*